US008434420B2

(12) United States Patent
Muller

(10) Patent No.: US 8,434,420 B2
(45) Date of Patent: May 7, 2013

(54) FOLDING HULL ELEMENT

(76) Inventor: Peter A. Muller, Gattikon (CH)

( * ) Notice: Subject to any disclaimer, the term of this patent is extended or adjusted under 35 U.S.C. 154(b) by 130 days.

(21) Appl. No.: 12/735,625

(22) PCT Filed: Feb. 6, 2009

(86) PCT No.: PCT/CH2009/000049

§ 371 (c)(1),
(2), (4) Date: Sep. 28, 2010

(87) PCT Pub. No.: WO2009/097706

PCT Pub. Date: Aug. 13, 2009

(65) Prior Publication Data

US 2011/0017119 A1 Jan. 27, 2011

(30) Foreign Application Priority Data

Feb. 6, 2008 (CH) ..... 158/08

(51) Int. Cl.
*B63B 1/22* (2006.01)
*B63B 17/00* (2006.01)
*B63B 35/40* (2006.01)

(52) U.S. Cl.
USPC ..... 114/284; 114/259; 114/285; 114/362

(58) Field of Classification Search ..... 114/259, 114/284, 285, 362, 365, 366
See application file for complete search history.

(56) References Cited

U.S. PATENT DOCUMENTS

| | | | | |
|---|---|---|---|---|
| 3,200,782 | A | 8/1965 | Walden et al. | |
| 3,695,204 | A | 10/1972 | Bennett | |
| 5,474,012 | A | 12/1995 | Yamada et al. | |
| 6,138,601 | A | 10/2000 | Anderson et al. | |
| 6,327,992 | B1 * | 12/2001 | Martin | 114/259 |
| 6,786,170 | B2 * | 9/2004 | Trowbridge | 114/259 |
| 7,121,226 | B2 | 10/2006 | Grimaldi | |
| 7,707,955 | B1 * | 5/2010 | Johns et al. | 114/259 |

FOREIGN PATENT DOCUMENTS

| | | | |
|---|---|---|---|
| DE | 199 63 057 | C1 | 12/2000 |
| GB | 2 262 718 | A | 6/1993 |
| WO | WO 00/50299 | A | 8/2000 |
| WO | WO 03/106254 | A | 12/2003 |
| WO | WO 2007/087736 | A | 8/2007 |

* cited by examiner

*Primary Examiner* — Lars A Olson
(74) *Attorney, Agent, or Firm* — George Pappas

(57) ABSTRACT

The invention relates to a hull element (7) which is fixed to the stern (1) or hull bottom (1*b*) by means of a hinge (6,6*a*) and enables an active as well as a passive trim of the watercraft (1*a*) and at the same time also supports a watercraft lift (2) or a watercraft stair (11) by means of the connector (8) or a connecting cylinder (18). By means of cylinder (17*b*) and the connector (8) or connecting cylinder (18) on the hull element (7) the platform (3) or the watercraft stair (11) can be activated. In case the watercraft lift (2) or the watercraft stair (11) is operated by means of cylinder (17*a*), the hull element (7) folds away, so that the stroke (H) of the watercraft lift (2) respectively the stroke (HT) of the watercraft stairs (11) is not impaired or restricted.

24 Claims, 5 Drawing Sheets

FOLDING HULL ELEMENT

This application claims priority of PCT application PCT/CH2009/000049 having a priority date of Feb. 6, 2008, the disclosure of which is incorporated herein by reference.

TECHNICAL FIELD

The invention is based on a hull element which is positioned at the end of the stern of a watercraft and upon need, can be folded down and at the same time serves as a flow and lifting body as well as an activitating mean for mobile watercraft lifts.

BACKGROUND OF THE INVENTION

Movable parts built onto the stern ends of watercrafts with a flow claim are known, such as trim tabs, which can be activated manually, electrically or hydraulically, whereby the mechanical spindle as well as the electrical and hydraulic cylinder lean against the stern of a watercraft as described in U.S. Pat. No. 3,695,204

Watercraft lifts for swimmers or tenders are known as a means of transporting persons or dinghies more comfortably and safely into or out of the water as described in DE patent 199 63 057 C1.

SUMMARY OF THE INVENTION

The invention involves that a watercraft equipped with a watercraft lift or a watercraft stair and a movable lifting hull element can both be connected so that, on the one hand the hull of the watercraft is lengthened, on the other hand the lifting hull element supports the watercraft lift or the watercraft stair by its buoyancy. In addition the trimming of the watercraft with loading in the stern area is improved by means of auxiliary static or dynamic buoyancy without interfering with the stroke of lowering the watercraft lift or the watercraft stair as the lifting hull element can be folded away.

Watercraft lifts are enjoying more and more popularity as dinghies and jetskis can be elegantly and efficiently picked up or just as easily be lowered into the water. Furthermore such lifts or a corresponding drop down stair are used by persons, especially on the larger yachts where there may be quite a gap to get on board or into the water.

The positioning of dinghies outboard of the stern of the watercraft puts a stress on the watercraft stern and also causes a trim change of the whole watercraft, as well as in the inoperative position of a weighty dinghy outside of the stern, triggers an extremely unfavourable weight distribution for the whole watercraft, especially during acceleration to planing and at the same time is a permanent strain on the stern structure especially in heavy seas due to the fluctuating dynamic forces which such a boat or also a lift causes on this exposed area.

The invention solves several conflicting issues, as the watercraft lift beneath the platform has a corresponding lifting hull element fixed and hinged to the stern of the watercraft which is placed behind the stern and advantageously placed under the platfom, whereby the platform and the lifting hull element are connected to each other by means of a connector so that the weight on the stern is reduced or completely neutralized by means of the buoyancy of the lifting hull element. In addition it ensures that not the total weight of the lift bears on the lift carrier fixations at the stern, but a part of the load is taken by the lifting body, hinged to the watercraft, by its fixation to the hull end, respectively at the lower stern area and gives there an additional support. Especially in rough seas or by wave jumping the stern of the watercraft is subject to forces, which, also by means of the lifting element can be induced into the lower part of the stern, respectively to the hull end, with the result that the forces are distributed. In case of technical failure, which means that the lift cannot be brought up again, then this can be elegantly solved by means of the lifting force on the lifting hull element, which had been previously set by the shipyard, and is advantageously higher than the weight of the lift or the stair so that the lift platform or stair can be lifted above the waterline until locked-in at the top.

On the grounds of the static and dynamic buoyancy of the lifting hull elements the watercraft does not hang so far down in the water with its stern, which otherwise leads to an unattractive trimming of the craft. When cruising the trim of the watercraft can even be at any time controlled precisely with the lifting hull element by substituting the connector by a cylinder. Correct trimming is not only an optical issue but also considerably improves the speed of the watercraft, reduces fuel consumption and lets the hull ride smoother through the waves.

All these technical and hydrodynamic advantages of the lifting hull element do not restrict the stroke of the watercraft lift or the watercraft stair in any way as this can be folded away when needed.

As far as the invention is concerned this is dealt with by the features of the first claim.

Quintessence of the invention is a lifting hull element that is fixed and hinged to the stern of a watercraft and is mechanically connected to a watercraft lift or a watercraft stair, on one hand to support the watercraft lift or the watercraft stair at the stern end by means of a static and dynamic lifting force, thereby improving the trim of the watercraft without restricting the stroke of the watercraft lift or the watercraft stair, as the lifting hull element can be folded away when needed.

Further advantageous features of the invention are listed in the subclaims.

BRIEF DESCRIPTION OF THE DRAWINGS

Various exemplary aspects of the invention will be described with reference to the drawings wherein. Identical elements are labelled in the various figures with the same references.

It shows

Only essential elements of the invention are schematically shown to facilitate immediate understanding

DETAILED DESCRIPTION OF EMBODIMENTS

Figure 1:
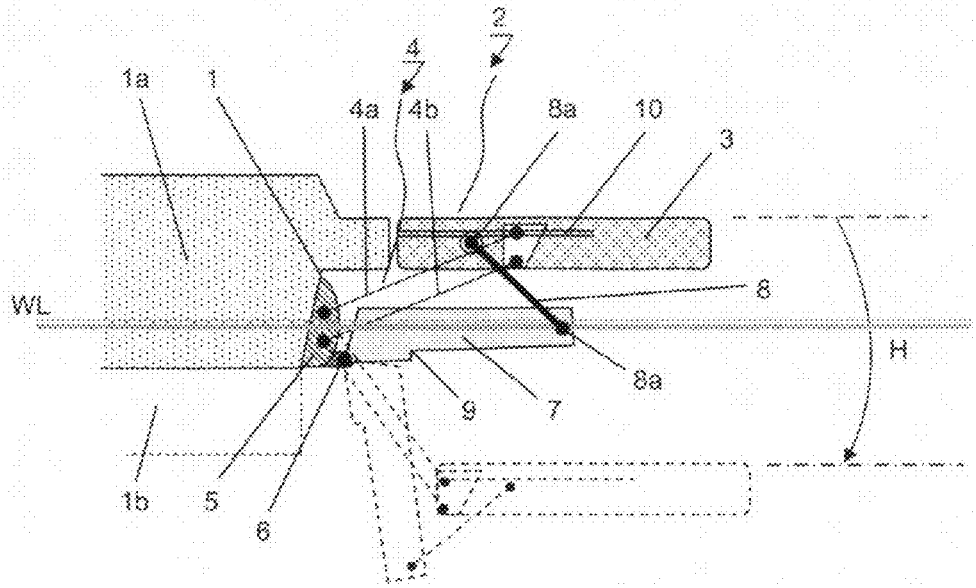
FIG. 1. A schematic sideview of a watercraft stern with a watercraft lift fixed onto it, a hinged hull element as well as a connector between lift and hull element FIG. 2 A schematic sideview of a watercraft stern with a watercraft stair fixed onto it, a hinged hull element, as well as a connector between lift and hull element FIG. 2*a* A schematic sideview of an unlock key with a time shifting mechanism for a locking gas spring FIG. 3 A schematic sideview of a watercraft stern with a watercraft lift fixed onto it and a hull element connected and hinged under the watercraft hull and a connector between lift and hull element FIG. 4*a* A schematic sideview of a watercraft stern with a watercraft lift fixed onto it and a hinged hull element as well as a connector between lift and hull element and a cylinder which is connected to one of the tilt arms and leans against the watercraft stern FIG. 4*b* A schematic sideview of a watercraft stern with a watercraft lift fixed onto it and a hinged hull element as well as a connector between lift and hull element and with a cylinder which is connected to the hull element and leans against the watercraft stern FIG. 5 A schematic sideview of a watercraft stern with a watercraft lift fixed onto it and a hinged hull element as well as an adjustable connector between lift and hull element FIG. 6 A schematic sideview of a watercraft stern with a watercraft lift fixed onto it and a hinged hull element as well as a connector between lift and hull element and two stroke ends FIG. 7 A schematic stern view of a watercraft stern with a watercraft lift fixed onto it with its tilting device and a hinged hull element which is connected to the watercraft lift by means of a lateral pivoting connector FIG. 8 A schematic overhead view of a watercraft stern with a fixed and hinged hull element and a hinge angle mean FIG. 9 *a*) A schematic sideview of a hinged hull element with a step, which *b*) runs at a right angle or angled or forms a free form recess FIG. 10 A schematic stern view of a hinged hull element which shows a twisted bottom FIG. 11A schematic sideview of a hinged hull element with a floodable chamber and a lateral stabilization plate FIG. 12 A schematic sideview of a hinged hull element with an integrated side thruster, separate trim tab, underwater lamp and gas discharge as well as connecting cables to the watercraft.

FIG. 1 Shows a schematic sideview of a stern 1 of a watercraft 1*a* with a watercraft lift 2 fixed onto it, which consists of a platform 3 on which a tilt arm set 4, consisting of tilt arms 4*a*,4*b* is mounted in the form of a parallelogram, and which is fixed and hinged to a console 5 and the console 5 is mounted on the stern 1. Details regarding bearings and such like, as well as the cylinder for lifting and lowering the platform, have been masked out. The hull bottom 1*b* with the deadrise is only indicated here and the deadrise of the hull element 7 is masked out. The hinged hull element 7 is fixed on the stern 1 by means of a hinge 6. The watercraft lift 2 and the hull element 7 are connected and hinged to each other with a connector 8 by means of the bearing 8*a*.

The hinged hull element 7 shows a lifting body with a static lift as long as the watercraft 1*a* rests in the water and has a dynamic lift when the watercraft 1*a* is planing, respectively up to a certain speed. The hull element 7 can also be added with a design without lifting bodies, so that it functions mainly like a large trim tab, that means does not generate any lift when at rest but generates a dynamic lift when cruising and innovative, when driving fast it will not produce any lift anymore, achieved by means of a step 9 in the hull element 7.

When swiveling the tilt arm set 4 the platform 3 is driven down by force activation as shown by arrow H. To ensure enough space for the hull element 7 or for other technical means at the stern 1, the platform is driven out on rails 10 according to arrow L, which is coercion adjusted for example by means of a push rod which is fixed between console 5 and platform 3, or the platform 3 moves itself horizontally by means of activating a hydraulic or electric cylinder. The connector 8 is fixed to the platform 3 and is further connected to the hull element 7 and when lowering the platform 3 the hull element 7 folds away, respectively downwards thereby elegantly giving way to the stroke H of the platform 3.

Figure 2:
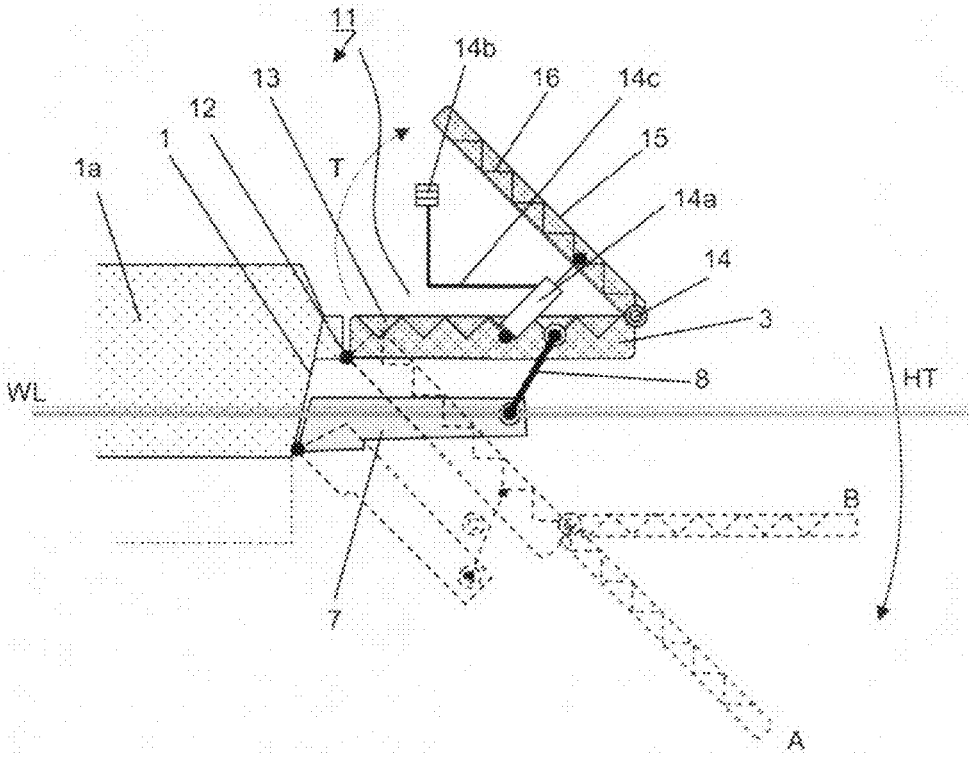

FIG. 2 Shows a schematic sideview of a stern 1 with a watercraft stair 11 fixed onto it and when in the horizontal position serves as platform 3 and can be pivoted downwards on joint 12 to serve as a stair on which the steps are able to be correspondingly turned in the horizontal position and thereby always remain in the horizontal position, whereby it is of advantage to have two joints 12 on the stern 1. Otherwise recesses are fixed on the platform 3 which form solid stair steps 13. So as to ensure that the stair steps 13 do not lay exposed in the horizontal position, these can be fitted with a suitable cover 15 which can be walked on. By means of cover hinge 14 the walkable cover 15 can be folded out manually or by means of a cylinder or a specific gas spring 14*a* according to arrow T or lockable gas springs by means of unlock key 14*b* and unlatch pipe 14*c*. The cover 15 can have for example integrated stair steps 16 and when completely folded out to position A gives a comfortable access to the water. Semi folded out, for example to position B and locked, with means as for example by a lockable or unlockable gas spring 14*a*, as well as without or only partially fitted with integrated stair steps 16, the rest fitted with a flat, slip-free surface, thus the inner side of the cover 15 forms an additional underwater platform. The cover hinge 14 can also be fixed laterally to the watercraft stair 11 and therefore enabling the cover 15 to be folded out laterally, so that the inward lying stair steps 16 together with the stair step 13 forms an even wider but shorter stair, which also can be stopped—especially in rough seas.

Under the watercraft stair 11 is the hull element 7, fixed to the stern 1 by means of a hinge 6 and when lowering the watercraft stair 11, the hull element 7 is folded down simultaneously by means of the connector 8 and therefore does not stand in the way of the stroke HT of the watercraft stair 11. Is the hull element 7 at the same time a static lifting mean, it will stabilize the watercraft 1*a* against rolling when walking on the watercraft stair 11, should this not be centred on the stern 1.

Not shown is a cord, which enables the cover 15 to be pulled in, on which a foldable stanchion is fixed and which in addition can be used as a railing.

If the watercraft stair 11 is not mounted entirely over the whole surface of the watercraft 1*a*, but only over a section, the cylinder 7, which allows the watercraft stair 11 to be lifted and lowered, according to arrow HT, may be fixed directly between the watercraft stair 11 and the stern.

Figure 2A:
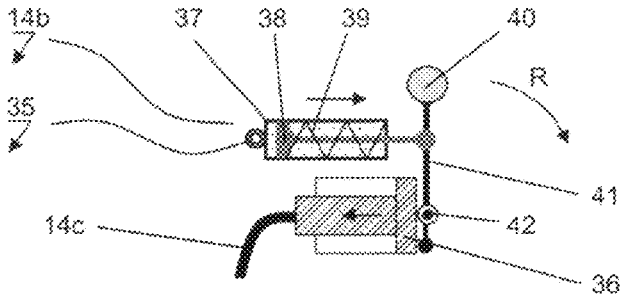

FIG. 2*a* Shows a schematic sideview of an unlock key 14*b* which has a time shifting mechanism 35 for a lockable gas spring 14*a* which unlocks when required and after a set time can automatically be locked again. Unlocking the lockable gas spring 14*a* is normally done by a latch key 36 and the unlatch pipe 14*c*, which releases a valve not shown here in the gas spring 14*a*. The time shifting mechanism 35 which is fixed on the not shown here cover of the unlock key 14*b* and connected to the transformation lever 41, contains a liquid eg filled with oil or silicone or similar liquid, a hinged shock absorber cylinder 37 with a rod 38 and with a pressure spring 39 placed inside it. Should the lever key 40 be pulled according to arrow R, then the latch key 36 is activated by the transformation lever 41 and hinge pin 42. By releasing the lever key 40 which will not immediately fall back to its original position by means of the pressure spring 39 but is slowly led back, braked by rod 38 which has a recess or a hole pattern so that the locked-in liquid can only flow slowly from one piston chamber into the other. Thereby the latch key 36 stays compressed for a given time and the unlocked gas spring 14*a* stays unlocked during this time, too.

Figure 3:
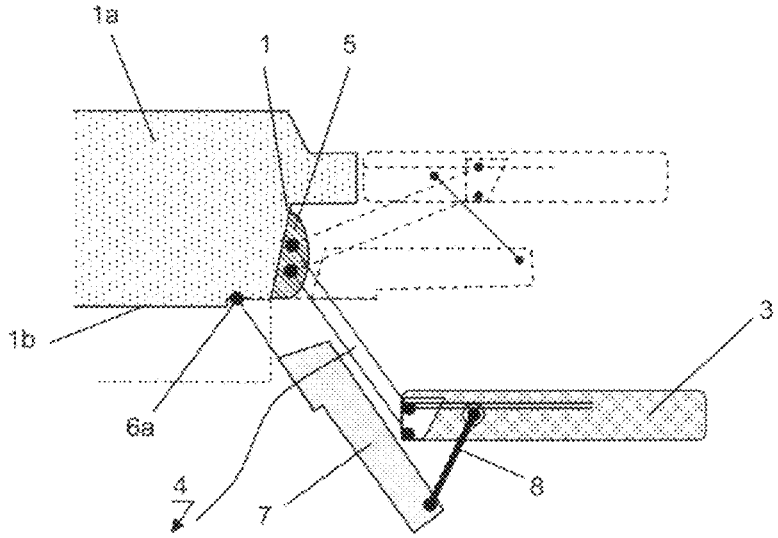

FIG. 3 Shows a schematic sideview of a stern 1 with a watercraft lift 2 fixed onto it and a hull element 7 fixed and hinged under the watercraft hull 1*b*. The pivot bearing by means of the offset hinge 6*a* is used in case the platform 3 generates a very large travel H or and the hull element 7 is shaped in a way that a collision could take place between hull element 7 and the lowering of platform 3. By shifting the hinge 6 from the stern 1 further forward in the direction of the watercraft 1*a* under the watercraft hull 1*b*, then space is generated by the altered kinematic, so that, by means of the connector 8 between platform 3 and hull element 7, the latter folds down in such a way that the whole travel H of platform 3 is guaranteed. The tilting up of hull element 7 is limited by this type of hinge fixture.

Figure 4A:
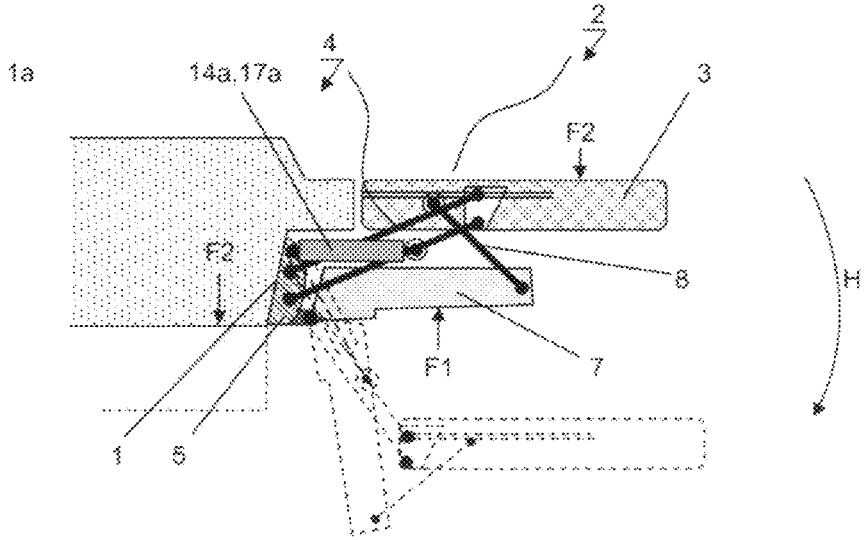

FIG. 4*a* Shows a schematic sideview of a stern 1 with a watercraft lift 2 fixed onto it and a hinged hull element 7, as well as a connector 8 between platform 3 and hull element 7, as well as a cylinder 17*a* which is connected to tilt arm 4*b* and braced to stern 1. The cylinder 17*a* operates the connector 8 as well as the hull element 7. The cylinder can be activated hydraulically, pneumatically or electrically. A special feature is the use of a gas spring 14*a*, especially of a lockable one which is activated by means of unlock key 14*b* and which needs the weight of a person to bring the watercraft lift 2 or the watercraft stair 11 down. Conversely, no person must stand on the watercraft lift 2, respectively watercraft stair 11, to bring it back up again, as this is solely done by retracting the piston of the gas filled gas spring 14*a*. Instead of having as usual, a drop down platform without solid bottom fixed on the stern 1, a lifting force F1 is created by means of hull element 7, which operates against the weight force F2 of the watercraft lift 2 and thereby positively supports the trimmability of the watercraft 1*a*. Furthermore, should for example the hydraulic system strike to function and the platform is already lowered, then the platform 3 can be lifted up, by means of the lift of the hull element 7, conveyed by connector 8, until it automatically snaps in and locks at the set position, whereby for this function, the cylinder 17*a,b* must first of all be set pressure-free. Should the platform 3 be carrying a tender, a high weight on the console 5 is noted, respectively on the stern 1, whereby the weight on the console 5 may be ideally reduced by means of hull element 7. Even when a platform 3 is fixed firmly onto the watercraft 1*a*, the stern is relieved 1 by means of hull element's 7 buoyancy and therefore may be used additionally as a sole dynamic trim element or and as a passive trim element when the watercraft 1*a* is in inoperative position, especially when having large engines in the stern area.

Figure 4B:
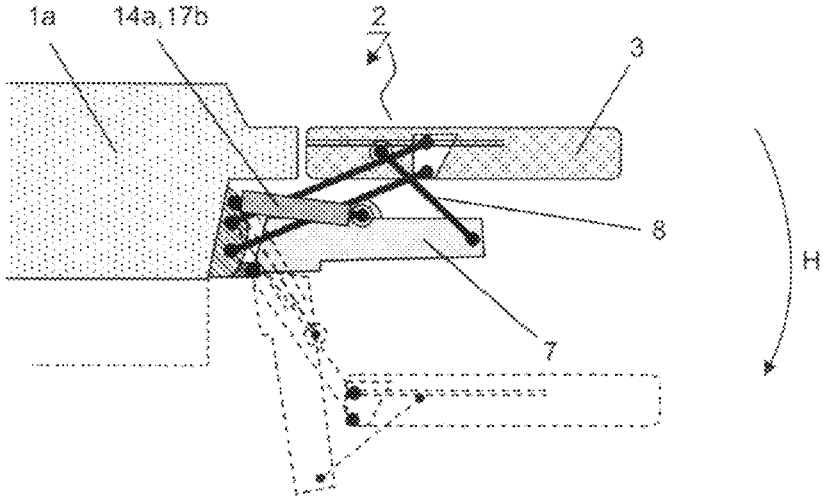

FIG. 4*b* Shows a schematic sideview of a stern 1 with a watercraft lift 2 fixed onto it and a hinged hull element 7, as well as a connector 8 between platform 3 and hull element 7, as well as a cylinder 17*b* or gas spring 14*a* which is connected to hull element 7 and connected to the stern 1. When the cylinder 17*b* is pushed out, the hull element 7 is pressed downwards and, by means of connector 8 between hull element 7 and platform 3, the latter is pulled downward and has the same function as that of a conventional watercraft lift 2 with its travel H. This configuration is of course also applicable for the watercraft stair 11.

Figure 5:
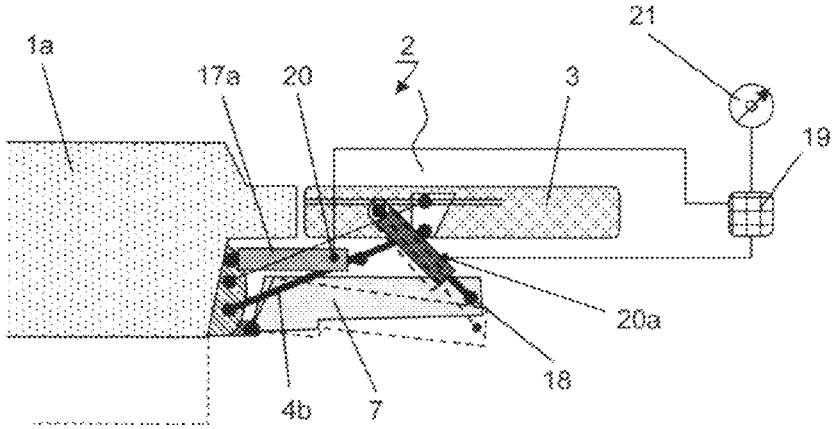

FIG. 5 Shows a schematic sideview of a stern 1 with a watercraft lift 2 fixed onto it and a hinged hull element 7, as well as a connector 8 between platform 3 and hull element 7, as well as a connecting cylinder 18 which replaces connector 8. The function of the hinged connection between platform 3 and hull element 7 remains the same, only that in this configuration, in which the cylinder 17*a* connects to tilt arm 4*b* in that the watercraft lift 2 is firmly locked in, the connecting cylinder 18 may be powered in and out separately and allows the hull element 7 to have its own trim tab function.

Therefore all the advantages of a conventional trim tab are covered as well. Should the watercraft lift 2 be lowered, then by means of position detection and control via a controller 19 and sensor 20, the connecting cylinder 18 returns to its set starting position, for example pushed out half of the travel or pushed out between complete or half travel, detected by sensor 20*a*. Only thereafter the watercraft lift 2 may become active. The hull element 7 may as well be completely driven in, which means pulled up at high speed, by means of the controller 19, detected by the speed sensor 21, eg GPS or dynamic pressure sensor or engine revving and such like, so that on the bottom of hull element 7 no coanda effect can be induced and so that a full waterflow stall takes place and any damaging friction forces may no longer occur.

Figure 6:
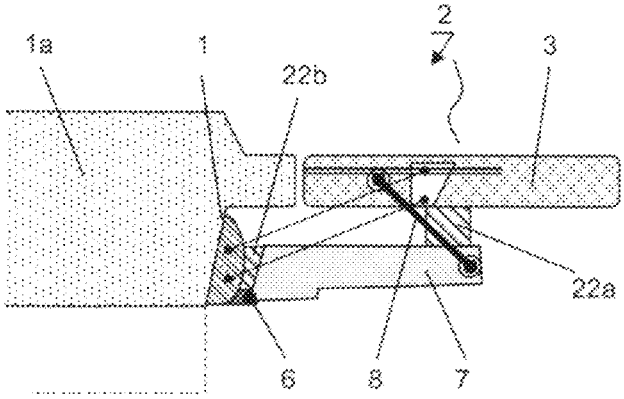

FIG. 6 Shows a schematic sideview of a stern 1 with a watercraft lift 2 fixed onto it and a hinged hull element 7, as well as a connector 8 between platform 3 and hull element 7, as well as a stroke end 22*a* between hull element 7 and platform 3. This takes the load off of the connector 8 or of the connecting cylinder 18 in case of pressure impacts from hull element 7 on connector element 8 and finally on platform 3 occurring permanently in heavy seas. In order to avoid these pressure impacts, in place of stroke end 22*a* or in addition to it, the stroke end 22*b* can be fixed between hull element 7 and stern 1. The stroke end 22*b* can be fixed or be variable so that it does not restrict the connecting cylinder 18, should this raise the hull element 7, so that it frees it completely from any damaging flow resistance from a certain speed onwards. The most powerful forces in high seas are absorbed, apart from by the hull element 7, from stroke end 22*b* and stern 1; the connector 8 respectively the connecting cylinder 18 are therefore only a distance holder between platform 3 and hull element 7.

Figure 7:
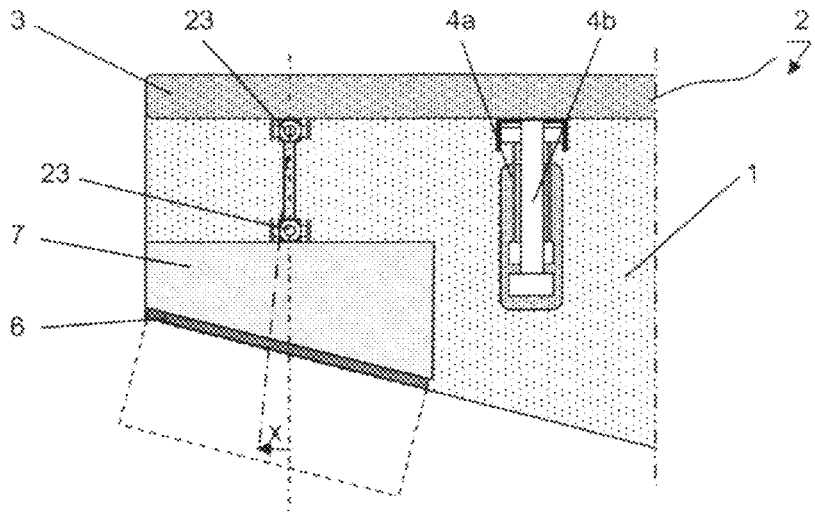

FIG. 7 Shows a schematic stern view of a stern 1 with a watercraft lift fixed onto it and a hinged hull element 7 which, by means of hinge 6 as well as a connector 8, having a pivot joint 23 at both ends, for example by means of a gimbal joint or ball joint, so that when folding down the inclined hull element 7 vs the horizontal platform 3, which results in a geometric offset x but the pivot joint 23 accounts for this issue, and thereby follows up with the resulting lateral deflection of the connector 8. Should there not be any pivot joint 23 wanted on the platform 3, then the offset x on the hull element 7 is compensated by a not shown here side shifting element or the like.

Figure 8:
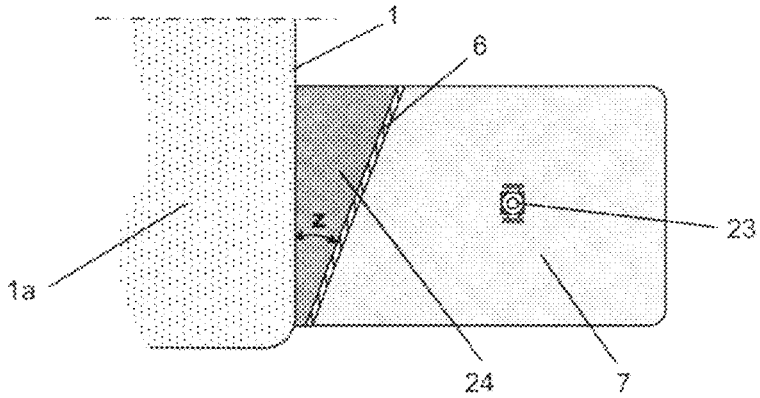

FIG. 8 Shows a schematic overhead view of a stern 1 with a hinge angle mean 24 fixed onto it with an angled hinge 6 at angle z on which hull element 7 is fixed onto. The angle z should correspond approximately to the deadrise of hull bottom 1*b*, which leads to a considerable reduction of the offset x on the hull element 7. Of course, the hinge angle mean 24 can be an integrated element to the watercraft 1*a* and as a result would be omitted as a separate part.

Figure 9:
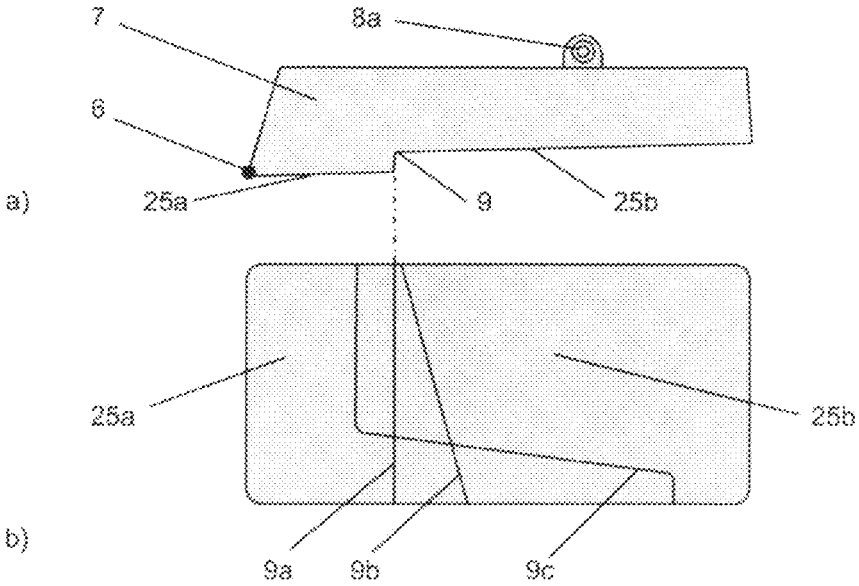

FIG. 9 Shows a) a schematic sideview of a hinged hull element 7 with steps 9, so that the bottom 25*a,b* of the hull element 7 is flow wetted by water when travelling at slow to medium speed and thereby creates a dynamic lift. At higher speed the wetted flow on the steps 9 stalls, the bottom 25*a* continues to generate lift and thereby supports the platform 3 with the connector 8 or stroke end 22*a*, whilst the bottom 25*b* is no longer flow wetted, thereby not creating any friction resistance. By lifting the hull element higher on the stern 1, then the bottom 25*a*, at a set speed, may also be freed from the flow, as the flow already stalls on the stern 1. FIG. 9*b* shows the various configurations of the bottom 25*a,b*. According to the watercraft type and task the step may be positioned in a right angle 9*a* to the flow or in an inclined angle 9*b* or in a non-linear shape 9*c*

Figure 10:
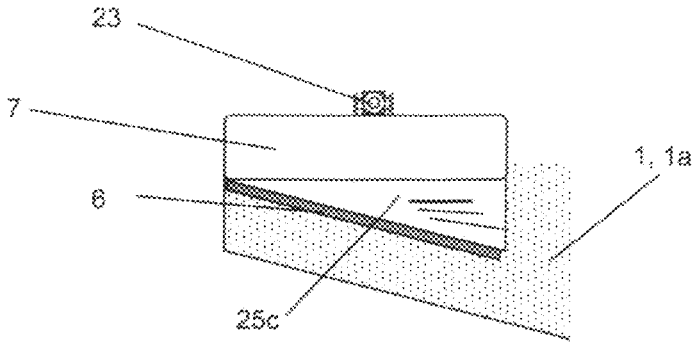

FIG. 10 Shows a schematic stern view of a hinged hull element 7, which has a twisted bottom 25*c*, which means the deadrise in the front part of the hull element 7 is approximately identical to the deadrise of the hull bottom 1*b* of the watercraft 1*a*, whereby the deadrise is more and more reduced backwards. Especially on a heavy watercraft 1*a*, in the transition phase from displacement to planing, a trimtab as flat as possible is advantageous which means as little as possible deadrise, therefore to generate as much lift as possible in the stern area. This is ideally achieved by means of twisting the bottom 25*c* of the hull element 7. The twisting can also be achieved in multiple horizontal or slightly inclined longitudinal steps which do not have to be necessarily in a free flow shape.

Figure 11:
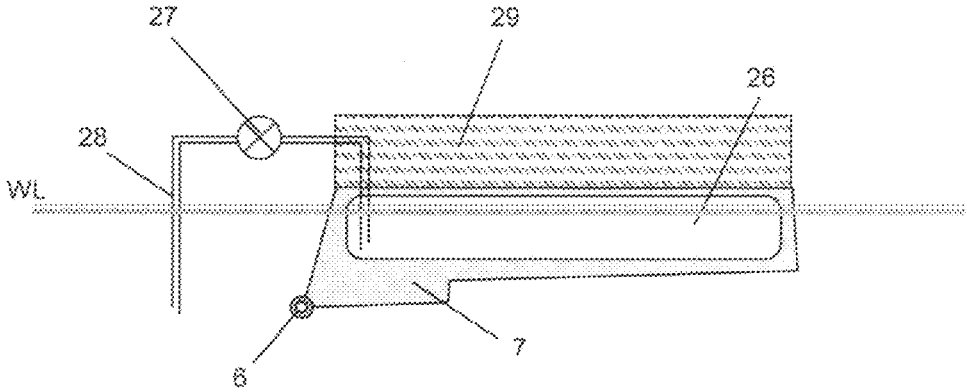

FIG. 11 Shows a schematic sideview of a hull element 7 with a flooding chamber 26 and by means of a pump 27 and pipe 28, water can be pumped in or out of the hull element 7. The flooding of hull element 7 leads to a stabilization of the watercraft 1*a* when lying at anchor, it makes it totally heavier and thereby lowers the entire hull of the watercraft 1*a* and for this reason again, leads to a further stabilization of the watercraft. Another way of stabilizing the watercraft can be achieved by means of a lateral stabilization plate 29 which act as baffle and reduces rolling of the watercraft 1*a* as soon as the hull element 7 is dropped down and the stabilization plate 29 is entirely positioned under the waterline WL.

Figure 12:
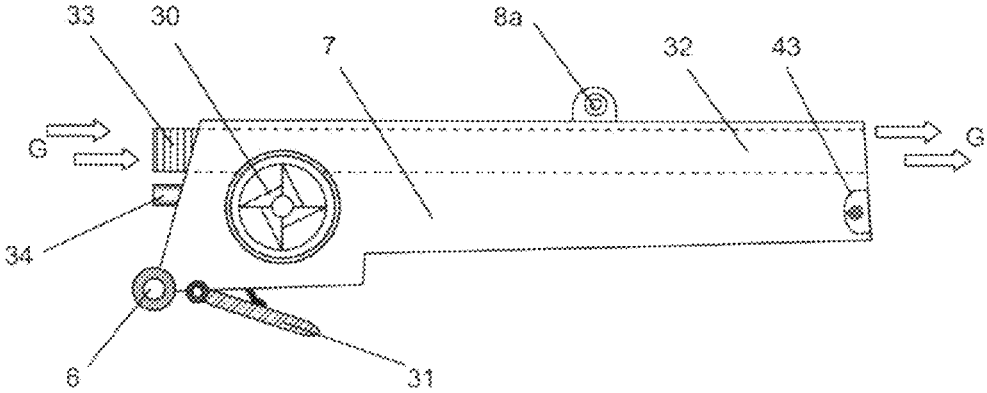

FIG. 12 Shows a schematic sideview of a hinged hull element 7 with an integrated sidethruster 30.

Through the firm connection between the hull element 7 and stern 1 by means of the hinge mean 6, a powerful sidethruster 30 can be implemented as well, as e.g. a standard sidethruster or a jet drive with the appropriate jet stream, without having the tilt arm set being exposed to a side force. In addition a separate trim tab 31 can be integrated into the hull element 7 in case no connecting cylinder 18 is foreseen. Furthermore, instead of cutting a hole in the hull of the watercraft 1*a* and continually having to worry about the sealing of the element, a light element 43 can be installed as enough space is available in the buoyant hull element 7. Engine fumes are always a topic and the further away from hull emitted, the more pleasant it is for the passengers on board the watercraft 1*a*, and this is effectively achieved by a gas discharge 32 through the hull element 7. Due to the drop down hull element 7, the exhaust pipe 33 is divided into two or is telescopic or formed as bellow or similar. The hydraulic or electrical supply pipes 34 have a corresponding length extension shape to compensate the distance displacement when folding down.

Of course the invention is not only applicable on shown and described examples

DRAWING LIST

1 stern
1*a* watercraft
1*b* hull bottom
2 watercraft lift
3 platform
4 tilt arm set
4*a*,4*b* tilt arms
5 console
6,6*a* hinges
7 hull element
8 connector
8*a* bearing
9*a,b,c* steps
10 rail
11 watercraft stair
12 joint
13 stair step
14 cover hinge
14*a* gas spring
14*b* unlock key
14*c* unlatch pipe
15 cover
16 integrated stair steps
17*a,b* cylinder
18 connecting cylinder
19 controller
20 sensor
21 speed sensor
22*a,b* stroke end
23 pivot joint
24 hinge angle mean
25*a,b,c* bottom
26 flooding chamber
27 pump
28 pipe
29 stabilization plate
30 sidethruster
31 trim tab
32 gas discharge
33 exhaust pipe
34 supply pipe
35 time shifting mechanism
36 latch key
37 shock absorber cylinder
38 rod
39 pressure spring
40 lever key
41 transformation lever
42 hinge pin
43 light element
H travel platform
HT travel stair
T fold out cover
R key travel
G exhaust direction
F1 lifting force
F2 weight force
WL waterline

The invention claimed is:

1. Watercraft having a watercraft lift or a watercraft stair, wherein said watercraft lift or a watercraft stair comprises a platform and wherein beneath said platform a hull element for additional lift is arranged, wherein said hull element is pivotally mounted at a stern of said watercraft or a hull bottom of said watercraft by means of a hinge means and is connected to said platform by means of a connection means or a connection cylinder, and wherein said hull element for additional lift comprises a step at its bottom and is mounted so that it generates a static lift and, during moving of said watercraft, a dynamic lift to said watercraft.

2. Watercraft according to claim 1 wherein said watercraft comprises a watercraft lift and wherein said platform is connected to the stern of said watercraft by means of a tilt arm set and a console and wherein said platform comprises rails for extending said platform.

3. Watercraft according to claim 2 wherein said watercraft lift can be directly activated by means of a actuator cylinder or a gas spring, wherein said actuator cylinder or a gas spring are engaged with said a tilt arm of said tilt arm set and whereby activation of the lift of said platform is carried out.

4. Watercraft according to claim 1 wherein said watercraft comprises a watercraft lift and wherein said watercraft lift is activated by an actuator cylinder or a gas spring and wherein said actuator cylinder or a gas spring is engaged with said hull element, wherein the lift of said platform is activated by means of a connection means or a connection cylinder.

5. Watercraft according to claim 1 wherein said watercraft comprises a watercraft stair and wherein said platform is connected by means of a hinge to the stern of the watercraft and wherein said platform comprises rails, by means of said rails the platform is extendable.

6. Watercraft according to claim 5, wherein said platform comprises stair steps and at least one hinge which is mounted at the stern of said watercraft.

7. Watercraft according to claim 1 wherein the lowering of said platform results in folding down of the hull element.

8. Watercraft according to claim 4 wherein a sensor is attached to said actuator cylinder in such a way that said actuator cylinder can be activated only when said connection cylinder is positioned in a start position and wherein said watercraft further comprises a sensor by means which said start position is detected.

9. Watercraft according to claim 1 wherein said platform is connected by means of a connection cylinder and wherein said watercraft comprises a speed sensor, wherein said connection cylinder is controlled in such a way that by reaching a predetermined speed of said watercraft, the connecting cylinder retracts and lifts the hull element.

10. Watercraft according to claim 1 wherein a stroke end is arranged between the platform and the hull element.

11. Watercraft according to claim 1 wherein a rigid or variable stroke end is arranged between said hull element and the stern of the watercraft.

12. Watercraft according to claim 1 wherein said step of the hull element is designed so that up to a predetermined speed of the watercraft the bottom in front and after said step are both wetted by water whereas above said predetermined speed of the watercraft at least the bottom after said step is not wetted by water.

13. Watercraft according to claim 1 wherein said platform is mounted by means of a tilt arm set with the stern of the watercraft, wherein an actuator cylinder is engaged with said tilt arm set and wherein said hull element is extendable and retractable by means of a connection cylinder whereby said hull element serves as a trim tab.

14. Watercraft according to claim 1 wherein said hull element is designed as a flooding chamber which, by means of a pump, can be flooded or nearly pumped empty.

15. Watercraft according to claim 1 wherein a stabilization plate is mounted on the hull element.

16. Watercraft according to claim 1 wherein said hull element comprises a side thrust device.

17. Watercraft according to claim 1 wherein said hull element comprises a separate trim tab.

18. Watercraft according to claim 1 wherein said hull element comprises a gas discharge element.

19. Watercraft according to claim 1 wherein said hull element comprises a light element.

20. Watercraft according to claim 1 wherein said hull element comprises a cover which has an integrated stair step and can be opened by means of a cover hinge.

21. Watercraft according to claim 1 wherein said hull element comprises a cover which has a flat surface and can be opened by means of a cover hinge.

22. Watercraft according to claim 21 wherein said cover is connected to the watercraft lift by means of a gas spring which is connected to an unlock key by means of a time shifting mechanism.

23. Watercraft according to claim 21 wherein said cover can be held in any desired position.

24. Watercraft according to claim 21 a foldable bar with a cord is attached between watercraft lift and the cover.

* * * * *